US005536117A

United States Patent [19]

Frame et al.

[11] Patent Number: 5,536,117

[45] Date of Patent: Jul. 16, 1996

[54] OFFSHORE TOWER STRUCTURE AND METHOD OF INSTALLATING THE SAME

[75] Inventors: Malcolm B. Frame, Surbiton; Majid A. Hesar, Welwyn Garden City; Jayan Varghese, Croydon; David G. Woodgate, West Wickham, all of United Kingdom

[73] Assignee: Kvaerner Earl and Wright, England

[21] Appl. No.: 322,325

[22] Filed: Oct. 13, 1994

[30] Foreign Application Priority Data

Oct. 13, 1993 [GB] United Kingdom ..... 9321078

[51] Int. Cl.[6] ..... E02B 17/02

[52] U.S. Cl. ..... 405/202; 405/204; 405/224

[58] Field of Search ..... 405/202, 203, 405/204, 208, 224, 225, 227

[56] References Cited

U.S. PATENT DOCUMENTS

| | | | |
|---|---|---|---|
| Re. 30,823 | 12/1981 | Guy et al. | 405/204 |
| 4,307,977 | 12/1981 | Haney | 405/227 |
| 4,669,918 | 6/1987 | Riles | 405/203 X |
| 4,705,430 | 11/1987 | Will | 405/204 |
| 4,735,526 | 4/1988 | Kawagoe et al. | 405/203 X |
| 4,743,141 | 5/1988 | Simensen et al. | 405/204 X |
| 4,781,497 | 11/1988 | Karsan et al. | 405/204 X |
| 4,818,145 | 4/1989 | Carruba | 405/227 X |
| 4,825,791 | 5/1989 | Foster, Jr. et al. | 405/203 X |
| 5,340,240 | 8/1994 | Carruba | 405/227 |

FOREIGN PATENT DOCUMENTS

| | | |
|---|---|---|
| 0277812 | 8/1988 | European Pat. Off. . |
| 1396415 | 6/1975 | United Kingdom . |
| 1491684 | 11/1977 | United Kingdom . |
| 2214548 | 9/1989 | United Kingdom . |

*Primary Examiner*—Frank Tsay
*Attorney, Agent, or Firm*—Bacon & Thomas

[57] ABSTRACT

A tower structure for offshore oil and gas fields is formed from various vertically spaced and interconnected tower sections. At least one of the tower sections is rotated about a vertical axis relative to another section so as to define a twisted portion. The number and orientation of the tower sections are varied depending on the particular environment and, particularly the water depth where the tower structure is located.

17 Claims, 6 Drawing Sheets

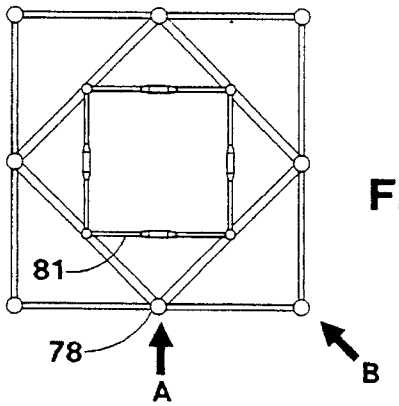
FIG. 10
FIG. 11
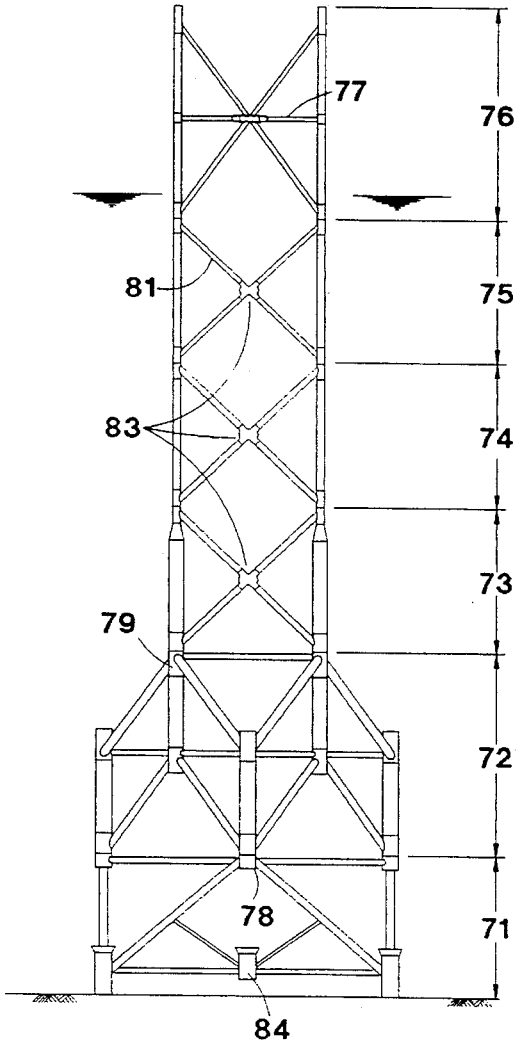
FIG. 12
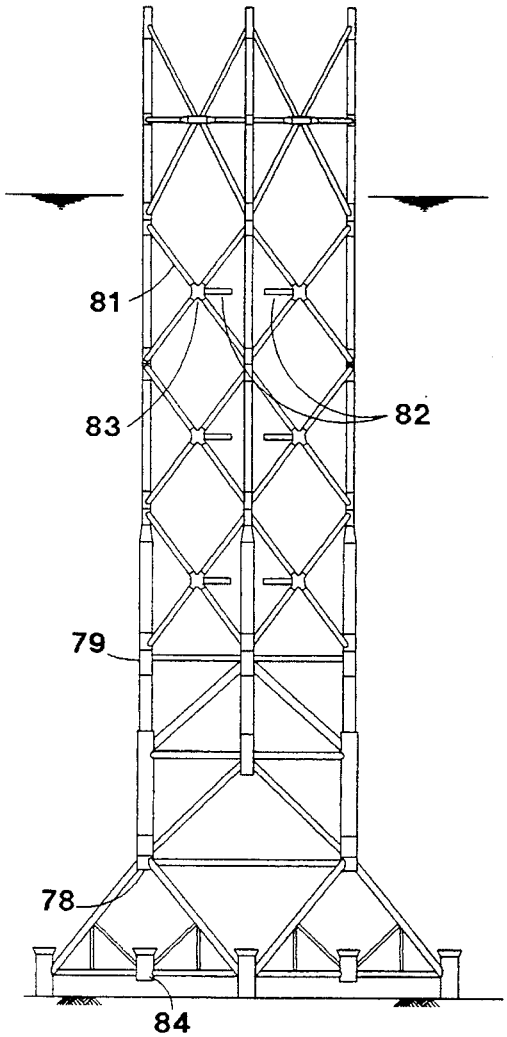

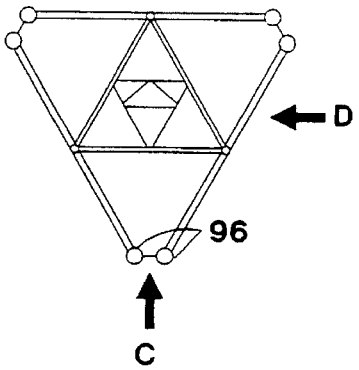
FIG. 13
FIG.14
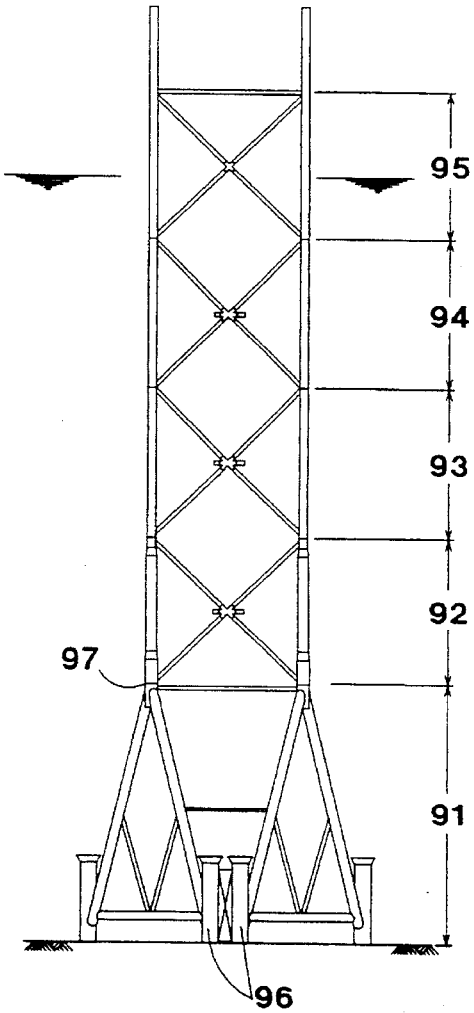
FIG.15
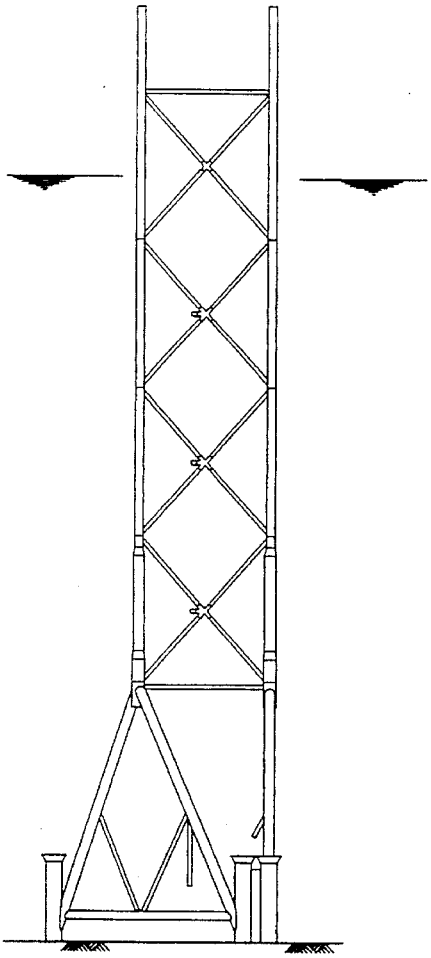

OFFSHORE TOWER STRUCTURE AND METHOD OF INSTALLATING THE SAME

BACKGROUND OF THE INVENTION

1. Field of the Invention

The present invention pertains to an offshore tower structure, and to a method of installing that structure.

2. Discussion of the Prior Art

The development of offshore oil and gas fields has led to requirements that fixed drilling/production platforms be placed in deeper and deeper waters, thereby calling for taller, more costly support structures and the optimization of the useful life costs of those structures. In evaluating useful life costs, all phases in the life of a support structure need to be considered, including the site installation.

Conventional support structures have generally been fabricated as three-dimensional lattices composed of tubular steel members, otherwise known in the offshore industry as "jackets". Heretobefore, such jackets have been built to their full height in fabrication yards, either upright or, in the case of taller jackets, horizontally lying on one side face thereof. These tall jackets have been transported in one piece on barges, and then either launched or lifted into the water for upending and piling onto the seabed. Loads imposed by the launching and lifting operations, which constitute a transitory phase of installation, often need to be reacted by additional members designed for that sole purpose. Jackets which contain members designed solely for the transitory phase of installation continue to carry these additional members after installation and, consequently, they will be over-designed for the rest of their operational lives.

The recently developed "twin lift" installation technique for heavy structures has led to requirements for highly specialized, and consequently expensive, heavy lift crane vessels for lifting and upending jackets to be installed in deep water. Associated crane costs, and the costs of extra members required specifically for the installation phase, can be a significant part of the whole life cost of such a support structure.

Many known support structures have been designed to have sloping faces, so that the jacket tapers continuously from a large plan area at its base to a smaller plan area at its top. Tapering a jacket in this manner gives the structure a wide foundation to resist overturning moments, while its reduced section in the wave affected zone near the top of the structure attracts relatively low wave induced loads. Within the offshore industry, this concept of tapering is known as "batter". The requirement for batter all the way up a jacket has led to the design of some unwieldy structures which have had oversized members near their bases. To alleviate these structural inefficiencies, it has been proposed to build jackets with an enlarged base, a single tapered section, and a tower of uniform cross-section. One example of this type of jacket is shown in U.K. Patent Specification 2214548.

Conventional jackets and spread base jackets of the kind referred to above have been transported and installed in one piece. However, multi-part tower structures have also been proposed. One example is shown in U.S. Pat. No. 4,797,034 in which an unbattered upper section is mounted for limited compliant movement on top of a battered lower section which is fixed to the seabed. Another multi-part tower arrangement is illustrated in U.K. Patent Specification 1,491,684. A practical example of a multi-part tower is the HONDO structure installed off Southern California. This structure evinced complex joints between parts of the tower and substantial additional weight had to be designed into the structure to enable the connections to be made underwater. In this tower and the remaining prior art arrangements discussed above, the legs of the structures were aligned all the way up from seabed to above the sea surface.

Based on the above, it should be readily apparent that utilizing heavy lift vessels in installing offshore oil and gas towers significantly adds to the overall cast of the structures. Therefore, there exists a need in the art for a multi-part tower structure which can be installed without the need for expensive heavy lift vessels and which still realizes the advantages of conventional battered structures, particularly in deep water applications.

SUMMARY OF THE INVENTION

A tower structure for offshore oil and gas fields is formed from various vertically spaced and interconnected tower sections. At least one of the tower sections is rotated about a vertical axis relative to another section so as to define a twisted portion. The number and orientation of the tower sections are varied depending on the particular environment and, particularly, the water depth where the tower structure is located.

The various tower sections are preferably formed from interconnected tubular, vertical leg members that are interconnected by tubular bracing members. The various tubular members can be interconnected in various ways, however, they are preferably attached by utilizing docking pins that include first and second end portions that respectively project into the tubular members to be mated. Once mated together, the tower sections can be structurally reinforced in various ways, such as supplying grout through suitable piping from a vessel on the sea surface to each connection location in a single operation.

Additional features and advantages of the invention will become more readily apparent from the following detailed description of the preferred embodiments thereof when taken in conjunction with the following drawings wherein like reference numerals refer to corresponding parts in the several views.

BRIEF DESCRIPTION OF THE DRAWINGS

FIG. 10 is a plan view of a third embodiment of the invention;

FIG. 11 is a side elevational view in the direction of arrow A of the third embodiment of the invention;

FIG. 12 is a side elevational view in the direction of arrow B of the third embodiment of the invention;

FIG. 13 is a plan view of a fourth embodiment of the invention;

FIG. 14 is a side elevational view in the direction of arrow C of the fourth embodiment of the invention;

FIG. 15 is a side elevational view in the direction of arrow D of the fourth embodiment of the invention.

DETAILED DESCRIPTION OF THE PREFERRED EMBODIMENTS

Figure 1:
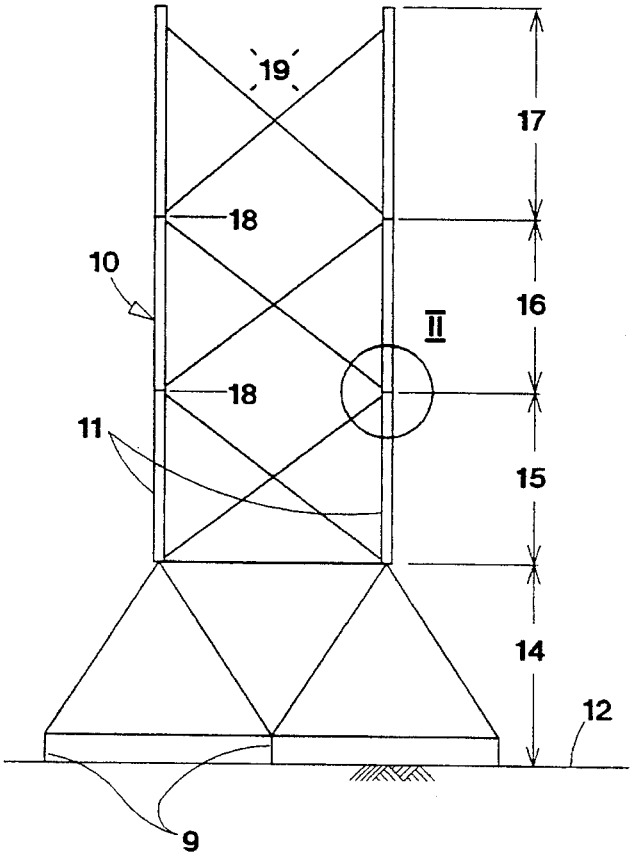
FIG. 1 is a side elevational view of a tower structure illustrating a first embodiment of the invention.

As shown in FIG. 1, a tower structure 10 of square plan form has legs 11 and rests on a seabed 12 in an upright position. The tower structure 10 is actually formed from four tower portions 14, 15, 16 and 17 stacked one on top of the other. Each leg 11 is thereby defined by the three vertically aligned tubular members of tower portions 15 to 17 connected together end to end and splices 18 are formed between the tubular leg members at vertical positions where tower portions 15 to 17 rest upon the next lower tower portion. Face bracing (generally indicated at 19) keeps the legs in their correct spatial relationship and transfers loads through the tower structure as a whole. The base portion 14 has pile sleeves 9 forming feet arranged at a 45° offset in plan from the legs 11 of the upper portions 15 to 17. Conductor (plan) bracing (not shown) is disposed at approximately mid-height within each tower portion, and is connected to the face bracing 19, but not to the legs 11 or splices 18.

Figure 2:
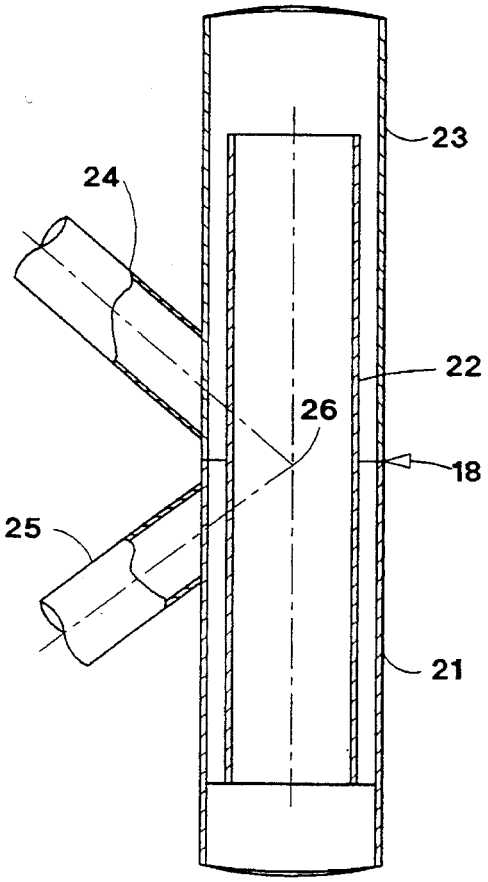
FIG. 2 is a detailed cross-sectional view of the region within the circle II of FIG. 1.

The internal arrangement of one splice 18 is shown in FIG. 2. Leg end 21 of lower tower portion 15 has a docking pin 22 fixed coaxially within it and extending upwards from it. Leg end 23 of upper tower portion 16 fits over the docking pin 22 and is securely connected to it by grouting, swaging or mechanical means. The ends of the face bracing members (here designated 24 and 25) are connected to the leg ends 23 and 21 respectively. The face bracing members 24 and 25 are arranged to run into the leg ends at 45°, with a 100 mm gap between the exterior of the bracing members 24 and 25 and the splice gap. Where possible, the centerlines of the ends of the face bracing members 24 and 25 and the leg ends 21, 23 are arranged to coincide at a single point 26.

Figure 3:
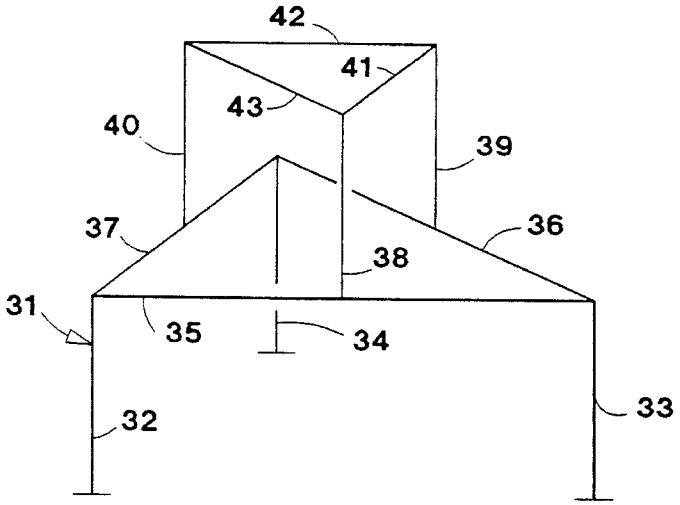
FIG. 3 is a very diagrammatic isometric sketch of a tower structure illustrating a significant feature of the invention.

FIG. 3 illustrates very diagrammatically how an upper tower portion is twisted rotationally about a vertical axis of a tower structure to give an effective batter to a multi-portion tower. In this case, a lower tower portion 31 has three legs 32, 33 and 34 joined at their upper ends by generally horizontal tie members 35, 36 and 37 respectively. An upper tower portion of smaller plan dimensions has three legs 38, 39 and 40 which are joined at their upper ends by generally horizontal tie members 41, 42 and 43. According to a feature of the invention, the lower ends of the legs 38, 39 and 40 rest on midpoints of the tie members 35, 36 and 37. In this way a multi-part tower structure can be given a progressively reducing cross-section as it rises from the seabed to above the surface of the sea. By providing a three legged tower structure as illustrated, the cross-section is reduced by half, noting that with a four legged tower structure, the reduction would be by $1/\sqrt{2}$.

Figure 4:
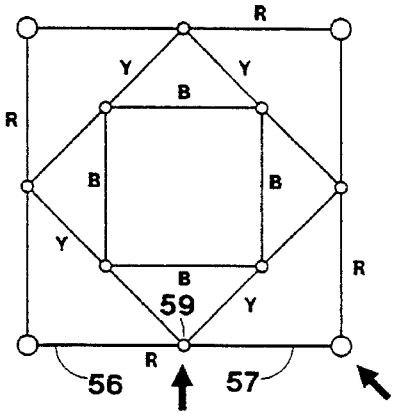
FIG. 4 is a plan view of tower structure illustrating a second embodiment of the invention.
Figure 5:
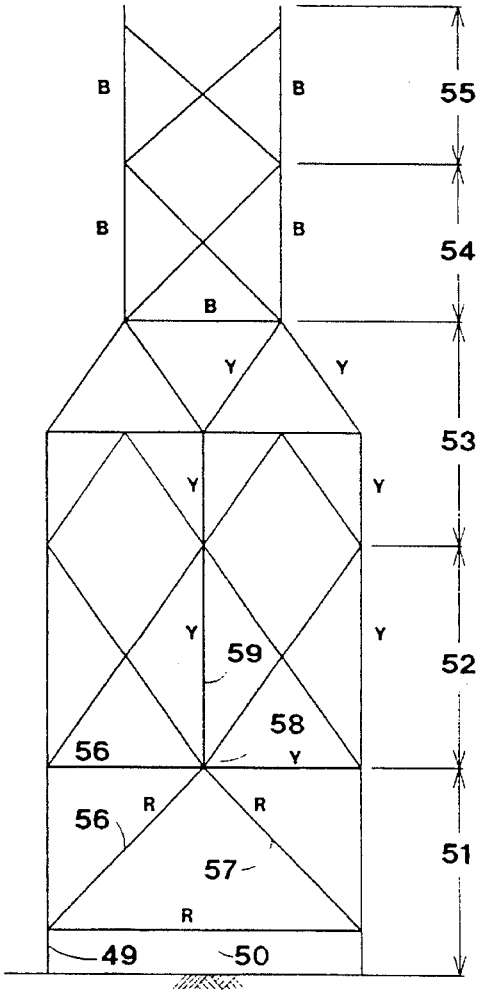
FIG. 5 is a side elevational view of the tower structure shown in FIG. 4.
Figure 6:
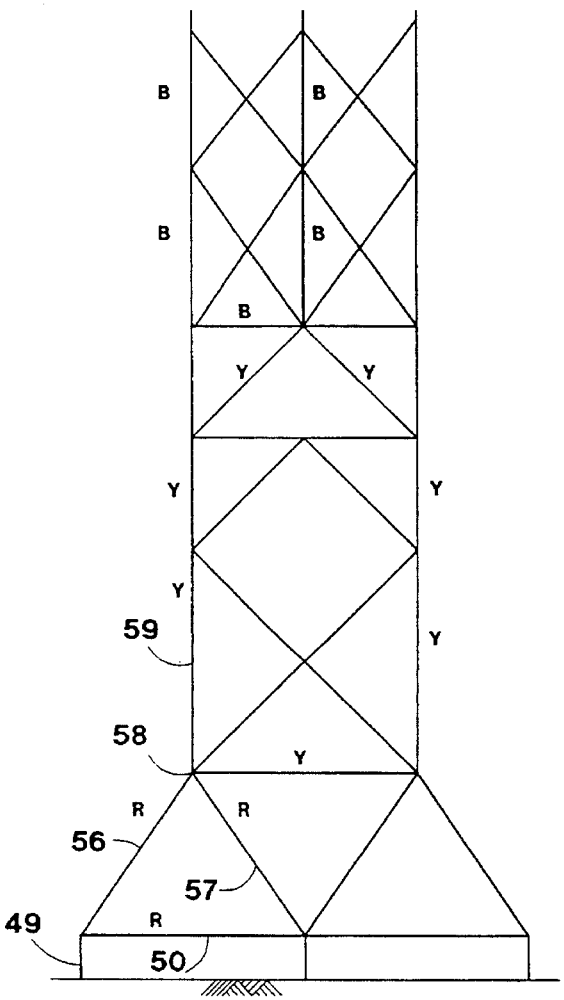
FIG. 6 is another side elevational view of that structure from a direction at 45° to the direction of the view in FIG. 5.

FIGS. 4, 5 and 6 show three views of a second preferred tower structure embodiment of the invention. In these figures, FIG. 6 represents an elevational view of the tower structure similar to that of FIG. 5 but rotated 45° relative thereto. In this case a tower structure of square plan form has five tower portions including two tapering sections (in the lowest portion and the middle portion). Vertically aligned splices are made between the leg ends of different tower portions; conductor (plan) bracing is arranged at intermediate levels between the splices; and a tapering configuration is achieved by placing the first and second, and the third and fourth portions with their faces offset at 45° to each other. For clarity, the conductor bracing is not shown in FIGS. 4, 5 and 6.

Figure 7:
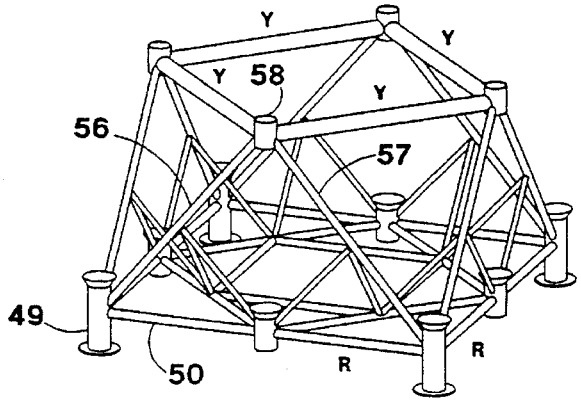
FIG. 7 is an isometric view of the lowest portion of the tower structure of FIGS. 4–6.

More specifically, in this tower structure the five tower portions are designated 51, 52, 53, 54 and 55. The lowest portion 51 is fixed to the seabed by piles passing through pile sleeves 49 at its four corners. The four corners are connected by horizontal base members 50. This lowest portion 51 has brace members 56 and 57 which extend upwardly and inwardly in a vertical plane to a splice joint at 58. The splice joint at 58 supports a vertical leg member 59 forming part of the tower portion 52. Because the leg portion 59 overlies the middle of the base member 50 of the tower portion 51, the distance between adjacent legs 59 is $1/\sqrt{2}$ of the distance between adjacent corners of the lower portion 51. This may be seen in the top plan view of FIG. 4. The effect is to create a "twist portion" which displaces the legs of an upper portion rotationally about a vertical axis by 45° with respect to the legs of a lower portion. The lowest portion 51 is illustrated in more detail in FIG. 7.

The tower portion 52 is of uniform cross-section and the legs 59 extend vertically upwards, with X-bracing being provided in the face portions of the tower between adjacent legs as clearly illustrated in these figures. The tower portion 53 has a lower half bay of uniform cross-section and an upper half bay in which the plan dimensions are reduced in a manner similar to that exhibited by tower portion 51. Two more tower portions of uniform cross-section with X-bracing in their vertical faces (portions 54 and 55) complete the tower structure. The tower portion 54 is connected to portion 53 in a manner similar to the connection of portion 52 to 51 and the tower portion 55 is connected to portion 54 in a manner similar to the connection of portion 53 to 52. To aid in visualizing the three-dimensional tower arrangement represented in FIGS. 4 to 8, outer boundaries of three specific vertical faces (which may form parts of more than one tower portion) are designated by the letters R, B and Y.

Figure 8:
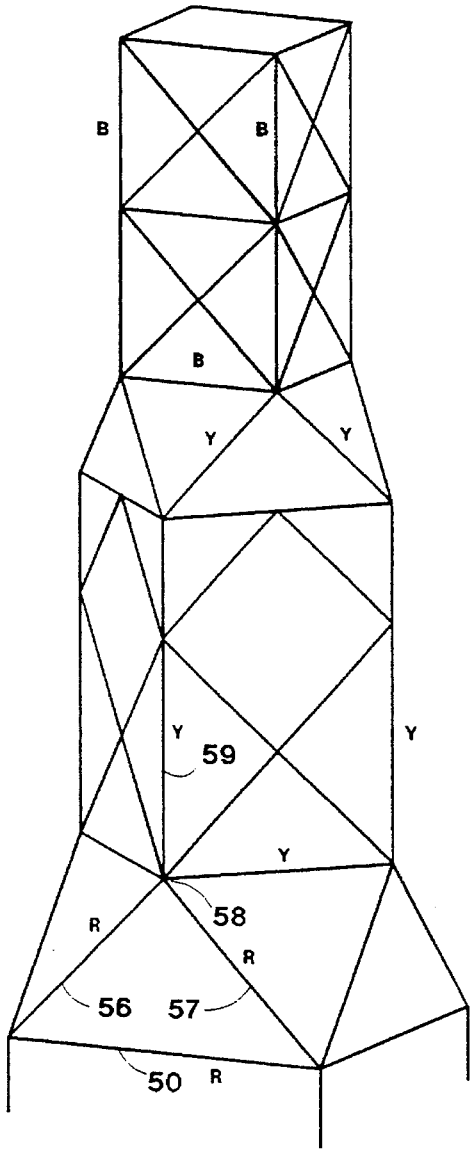
FIG. 8 is an illustrative isometric view showing front members only of a four legged multi-portion tower.

By making two half twists, i.e., between portions 51 and 52 and between portions 53 and 54, the cross sectional dimensions have been reduced by $1/\sqrt{2}$ twice over, i.e., halved. In this way the completed tower structure has a progressive taper from bottom to top. This tower structure can also be assembled in relatively small lifts as compared with a conventional jacket of similar overall weight and dimensions. This has been achieved by the half interior angle twist created by fixing a vertical leg of an upper portion over face bracing upstanding over the middle of a side of a lower portion. A diagrammatic view of the structure illustrated in FIGS. 4 to 6 is shown in FIG. 8. This view is shown from a direction midway between the side elevations of FIGS. 5 and 6.

The tower portions 51 to 55 are built, loaded out, transported and installed in an upright condition. This reduces the steelwork which would otherwise be required to satisfy design cases relating to rotation of the structure. For example, the launch frame bracing required in conventional barge launched jackets is eliminated. Construction in an upright condition also reduces external temporary works because construction aids can be used for in-place functions in the permanent structure. Tower portion heights and the number of tower portions to be used can be engineered to give leg bracing angles in the range of 40° to 50°, which makes welded joints easier to assemble. The tower portions can be constructed simultaneously (possibly at different sites) thereby saving overall construction time.

Figure 9:
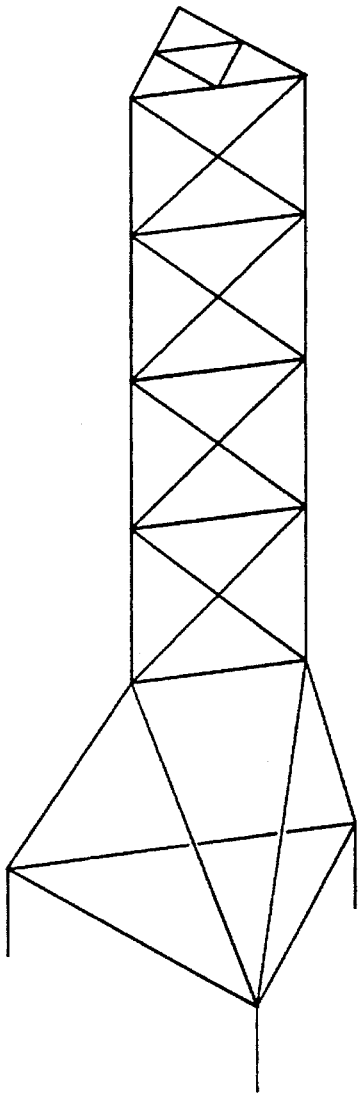
FIG. 9 is an illustrative isometric view showing front members only of a three legged multi-portion tower.

FIG. 9 is another diagrammatic view (similar to FIG. 8) showing a three leg multi-portion tower provided with just one twist (through 60°) in accordance with the present invention giving a half size reduction.

FIGS. 10–12 are more detailed drawings of a third embodiment of the invention, showing a tower structure engineered for a particular need. In this case the tower structure was designed to stand in 100 m of water in a northern North Sea location with a typical subsea soils profile (2 m of dense sand overlying stiff to hard clay) and with a topside load of some 2000 metric tons and a 4×3 conductor array located within and offset towards one face of the structure. The top plan of the structure was set to be 18 square meters. The detailed drawings were prepared for a particular fabricator, and there has been some selectivity in the way in which particular members have been suppressed in the drawings to make those drawings clear.

In general, a tower structure with only 18 m plan dimensions throughout would only be suitable for shallow water depths. In accordance with the invention, requirements for platforms in deeper water can be met by providing one or more "twist portions". A square "twist portion" is oriented at 45 degrees in plan to the tower portion above and, by still joining the support points at 18 m spacing, forms a new square of $18\sqrt{2}$ (25.456) meter sides. In a similar way, subsequent twists form further squares with sides of 36 m, $36\sqrt{2}$ (50.912) meters etc. If required, "twist portions" can be separated by other portions of uniform cross-section. This gives more flexibility in building up a tower structure to suit any particular water depth.

For a water depth of 100 m, the most suitable configuration for a tower structure with a top plan size of 18 m has been found to have two "twist portions", giving a square base of side 36 m. FIGS. 10 to 12 show the configuration of the uniform cross section portions and the two "twist portions" for this embodiment.

In the preferred embodiment described and shown, this multi-portion tower structure is fabricated as a series of six tower portions intended to be installed one on top of the other to build up the required height. In this third embodiment of the invention, the six tower portions are designated 71, 72, 73, 74, 75 and 76. Tower portions 71 and 72 are 'twist portions', each turning through 45° and the remaining four portions 73 to 76 are of uniform cross-section. Because of its additional height, the top tower portion 76 has horizontal face bracing 77.

To facilitate the connection of the tower portions, they are configured with vertical legs (or stubs). For instance, the twist portions 71 and 72 have vertical stubs 78 and 79 respectively, and the portions of uniform cross section have vertical legs. Docking pins (not shown) protrude vertically from each of the legs of one portion to locate into the legs (or stubs) of the next portion. With this arrangement, the installation aids become a permanent and direct load path for the assembled tower.

The basic framing configuration is interconnected by X-bracing 81. Preferably, the configuration comprises X-braces in the four vertical faces of the tower structure. The center of each X-brace is restrained due to its support of the conductor (plan) bracing 82 (shown in part in FIG. 12). The plans are diamond shaped, i.e., they form an inner square twisted at 45 degrees. This bracing configuration is very efficient, due to its excellent redundancy characteristics. (For clarity, no conductor bracing is shown in FIG. 10, which is a simple plan view of piles, legs and face bracing.) Other advantages of this framing pattern are that the leg nodes constitute simple and efficient K-joints, and the crotch area of each joint is left free for routing of flowlines down the legs. These K-joints are symmetrical about the splices between tower portions of uniform cross-section (e.g. portions 74 and 75). In the preferred embodiments, the X-braces are angled at 45 degrees for ease of fabrication and structural efficiency. With vertical faces, they are also angled at 90 degrees to the plans. This arrangement gives a very simple X-node geometry which is repeated twelve times, and is thus suitable to be manufactured as a repetitive casting.

The tower structure shown in FIGS. 10–12 requires a number of complex nodes 83 with very similar geometry. These nodes join the four X-bracing members 81 in the vertical plane and two conductor bracing members 82 in the horizontal plane. As castings, these nodes 83 may be significantly lighter than fabricated nodes (estimated weight approximately 6 metric tons). Their repeatability also allows cost savings. A further advantage of this casting is that the pattern can be readily adjusted to accept a range of brace diameters and angles. Thus for some water depths, this casting could also be used in the non-standard top portion 76 of the tower structure.

The tower portions are mated together with the aid of docking pins. (FIG. 2 shows a typical splice arrangement.) Obviously, the docking pins can either protrude upwards from the legs of the lower portion (as shown) or downwards from the legs of the upper portion. In the base portion 71, the four interior piles pass through pile sleeves 84 and stick up to form the docking pins for the portion 72. Once mated together, the tower portions can be connected in a variety of ways. The base case (shown in FIG. 2) evinces the annular gap between the pin 22 and leg end 23 and is grouted. With this approach, the splice becomes a "Double Skin Grout Reinforced Tubular" Connection. The strength of the splice is utilized for support when the tower is erected; this enables the thicknesses of the leg K-joints to be reduced and avoids the likely requirement for Post-Weld Heat-Treatment.

The grouted connections can be made in a single operation after all tower portions are in place, preferably through suitable piping from a vessel on the sea surface. A grout line is connected to an ROV stab-in point at the bottom connection, and grout flows up through hard or soft piping to each connection in the leg to the top of the tower structure. An alternative procedure is to stab-in the grout line to each connection in turn. For grouted connections, the docking pins (e.g. 22 in FIG. 2) are designed to protrude upwards, so as to provide a stiffened connection between the docking pin 22 and the leg end 21 on the lower portion which gives the following advantages: the connection also acts as packer to retain grout and the connection transfers part of the tensile loads from the pin into the leg, hereby reducing the required grouted length on the more severely loaded lower portion.

An alternative to grouted connections is to swage the tower portions together. In this latter case (not shown) the legs could be of constant diameter throughout to allow entry of the swaging tool. This is less preferred than grouting as it may be somewhat inefficient structurally and, by attracting additional wave loading, may give larger steel and welding requirements. An additional inconvenience of swaging is that the connections would have to be made after each individual tower portion was installed. However, swaging of the interior pile stick-up on the base portion 71 to the intermediate twist portion 72 does not suffer from these disadvantages. A swaged connection here would utilize the same swaging tool as the other pile connections. It would also save pile steel by reducing the required stick-up height (the required grouted connection length is about 7.5 m). However a swaged connection would require the legs of the intermediate twist portion 72 to remain open to seawater, which could present some corrosion problems.

One advantage of the multi-portion tower structure is that it is simple to remove at the end of its field life, and it is possible to reuse some or all of the portions at an alternative location. This approach requires a form of connection which can be released without damaging adjacent structural members. Being part of the main leg members in the tower structure, the connection must also be highly resistant to extreme storm and long term fatigue loading. Potential reversible connection arrangements include tensioned connections and mechanical connectors. In the first case, a tensile member is passed through the legs of all the portions and then tensioned to prestress the leg sections together. A disadvantage of this concept is that environmental loading dominates the tower structure design and thus leg loads are large in tension as well as in compression. Thus the steel requirement of the combined tension member and leg section is more than twice that of a leg without prestress. Various types of mechanical connectors known for use in joining tubes together in offshore applications could be utilized. These include connections in pipelines, conductor casings etc. Potential disadvantages of these mechanical connectors are their expense, weight and diameter limits.

Figure 16:
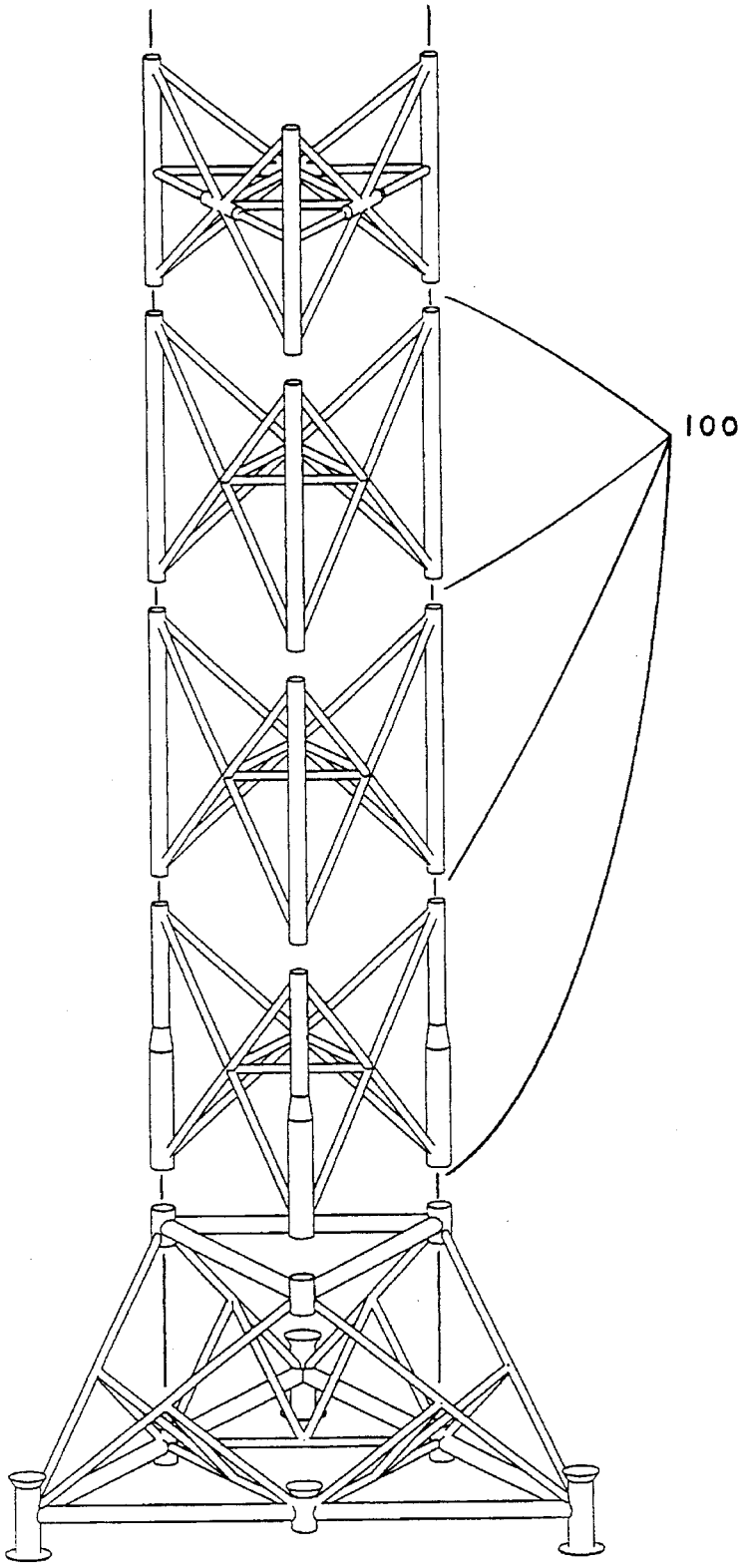
FIG. 16 shows the assembly of the fourth embodiment of the invention.

The multi-portion tower structure of the present invention contains many details that can be repeated both in a single tower structure and across a standardized range of tower structures. As water depth increases, the approach is to add increasingly large tower portions to the bottom of the tower structure, leaving the upper portions virtually unchanged from the tower structure for shallower water. In accordance with the invention, the upper tower sections can be lifted from a transportation barge and then slid down one or more guide wires 100 (as shown in FIG. 16), which can extend through one or more legs of the upper tower portion, to aid in aligning the docking pins on the tower portion below.

The multi-portion tower structure also offers the possibility of using the base portion 71 as a pre-installation drilling template. However, as the base portion is an integral part of the tower structure, the fabrication lead time may be too long to facilitate this option for pre-drilling where time is short, in which case a simpler purpose-built drilling template would be used.

FIGS. 13, 14 and 15 show a fourth embodiment of the invention, in which a tower structure has been engineered for another particular need. In this case the tower structure is designed to stand in 90 m of water in a central North Sea location with 6 conductors and a very light topside load. The tower structure has five tower portions 91, 92, 93, 94 and 95. Only the base portion 91 is what has been termed a 'twist portion'. A leg spacing of 18 m was selected for the other tower portions 92 to 95.

The base portion 91 is configured with two piles 96 at each corner. This differs from the arrangement adopted in the third embodiment in which single piles were located at each corner, other single piles were located centrally between the corners and the central piles were extended upward to provide docking pins for the upper portions. The latter approach is particularly efficient for substructures that are required to support a significant topside load. However, for a lightly loaded platform, the foundation design is governed by environmental loading, hence, locating the piles 96 at the corners of the base portion 91 would seem to be the most efficient arrangement. However, the design of joints 97, and the connections to the pile sleeves, will be more complex.

An attractive feature of the multi portion tower structure concept is that the rotation of the upper portions relative to the base portion enables one set of corner piles to be located along the centerline of an adjacent jack-up rig hull. This allows the clearances between the piles 96 and jack-up rig spud cans to be maximized.

More generally, the multi-portion nature of tower structures in accordance with the invention introduces possible cost savings over conventional jackets. Fabrication would benefit on two levels. Firstly, the design philosophy of maximizing repeated units and details within the structure reduces the complexity of the fabrication and the modular approach to fabrication reduces the need for heavy lifting equipment. Secondly, repeated orders would allow the reuse of fabrication jigs and templates, and familiarity with the fabrication procedure should reduce fabrication time.

The main strength of a tower structure is down the axes of the legs, and any temporary condition which imposes loadings normal to the legs will necessarily be inefficient and lead to additional expense. All the phases of frame roll-up, load-out, transportation, lift and upending are precisely such temporary conditions. It is for this reason that a tower structure in accordance with the invention is constructed and installed as separate tower portions which are fabricated, transported and lifted standing upright.

As mentioned above, one primary component in the overall cost of a platform is the installation cost. The multi-portion tower structure of the present invention avoids the requirement for large heavy lifting vessels and therefore opens the way for smaller lift vessels. This has been estimated to reduce significantly the cost of installation even taking into account the extra time required offshore to make the splice connections required.

We claim:

1. A tower structure for offshore use comprising:

a lower tower portion including a plurality of pairs of inclined legs, each of said legs having upper and lower ends and each of said pairs of inclined legs being arranged in a respective one of a first set of at least three substantially vertical planes, said plurality of pairs of legs being interconnected at their lower ends by a plurality of first tie members, and being interconnected to each other at their upper ends;

an upper tower portion including a plurality of legs and a plurality of second tie members, each of said plurality of legs of said upper tower portion including upper and lower ends and being arranged in a respective one of a second set of at least three substantially vertical planes, said plurality of legs of said upper tower portion being interconnected at their upper and lower ends by respective ones of said plurality of second tie members;

means for mounting said upper tower portion upon said lower tower portion with the lower ends of the plurality of legs of said upper tower portion being positioned offset from the lower ends of the plurality of legs of said lower tower portion; and the arrangement being such that the second set of substantially vertical planes is offset from the first set of substantially vertical planes by rotation about a vertical axis with respect to the first set of substantially vertical planes.

2. A tower structure as claimed in claim 1, wherein the legs of the upper tower portion are upright.

3. A tower structure as claimed in claim 2, wherein said mounting means define splice joints at connection locations between said upper and lower portions, said splice joints including docking pins which extend within the lower ends of the upright legs of said upper tower portion and are secured to said lower tower portion.

4. A tower structure as claimed in claim 2, further including an interior pile element for securing said lower tower portion to a seabed, said interior pile element having a stub portion to which one of said lower ends of the upright legs of said upper tower portion is attached.

5. A tower structure as claimed in claim 1, wherein said pairs of inclined legs are arranged in four substantially vertical planes.

6. A tower structure as claimed in claim 5, wherein the second set of substantially vertical planes is offset from the first set of substantially vertical planes by rotation about a vertical axis by an angle of 45° with respect to the first set of substantially vertical planes.

7. A tower structure as claimed in claim 1, wherein said pairs of inclined legs are arranged in three substantially vertical planes.

8. A tower structure as claimed in claim 7, wherein the second set of substantially vertical planes is offset from the first set of substantially vertical planes by rotation about a vertical axis by an angle of 60° with respect to the first set of substantially vertical planes.

9. A tower structure for offshore use comprising:

a lower tower portion including base members defining at lest three polygonally spaced base points and face bracings attached to said base members and extending upwardly and inwardly from said base members in a first set of at least three substantially vertical planes to attachment points located above and between said base members, each of said attachment points defining attachment joints which are relatively spaced a distance less than the relative distance between said base points;

an upper tower portion including a plurality of leg members in a second set of at least three substantially vertical planes, and having lower ends defining a base for said upper tower portion, each of said lower ends being attached at a respective one of said attachment joints; and the arrangement being such that the second set of substantially vertical planes is offset from the first set of substantially vertical planes by rotation about a vertical axis with respect to the first set of substantially vertical planes.

10. A tower structure as claimed in claim 9, wherein the base points defined by said base members are located in a common, generally horizontal plane and the lower ends of said leg members of said upper tower portion are also located in a common, generally horizontal plane.

11. A tower structure as claimed in claim 9, wherein each of said plurality of leg members of said upper tower portion extends vertically and is positioned above and between respective base members of said lower tower portion.

12. A tower structure as claimed in claim 11, wherein said attachment joints define splice joints including docking pins which extend within lower ends of said vertical leg members of said upper tower portion and are secured to said lower tower portion.

13. A tower structure as claimed in claim 9, wherein said upper tower portion further includes a plurality of tie members which extend between and interconnect said plurality of leg members.

14. A tower structure as claimed in claim 9, wherein said face bracings lie in vertical planes.

15. A method of installing an offshore structure comprising:

installing a lower tower portion, including a plurality of legs extending in respective, substantial vertical axes, to a seabed; and attaching an upper tower portion, including a plurality of legs, upon the lower tower portion with the upper tower portion being twisted relative to the lower tower portion such that the plurality of legs of said upper tower portion define axes which are offset from the substantially vertical axes associated with the legs of said lower tower portion.

16. A method of installing an offshore tower structure as claimed in claim 15, further comprising:

attaching the upper tower portion to the lower tower portion at splice joints in a readily detachable manner.

17. A method of installing an offshore tower structure as claimed in claim 15, further comprising:

guiding the positioning of said upper tower portion upon the lower tower portion through the use of a guide wire extending from the lower tower portion, through one of said plurality of legs of said upper tower portion, to an installation vessel.

* * * * *